US006905408B2

(12) United States Patent
Inoue

(10) Patent No.: US 6,905,408 B2
(45) Date of Patent: Jun. 14, 2005

(54) SYMBOL DISPLAY DEVICE FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 208 days.

(21) Appl. No.: 10/238,787

(22) Filed: Sep. 11, 2002

(65) Prior Publication Data

US 2004/0014516 A1 Jan. 22, 2004

(30) Foreign Application Priority Data

Jul. 17, 2002 (JP) ..... 2002-208582

(51) Int. Cl.[7] ..... A63F 9/24
(52) U.S. Cl. ..... 463/21; 273/143 R
(58) Field of Search ..... 463/16, 20–22, 463/30; 273/143 R

(56) References Cited

U.S. PATENT DOCUMENTS 4,826,169 A * 5/1989 Bessho et al. ..... 273/143 R
4,836,546 A * 6/1989 DiRe et al. ..... 463/18
5,152,529 A * 10/1992 Okada ..... 463/20
5,395,111 A 3/1995 Inoue
5,752,881 A * 5/1998 Inoue ..... 463/20
5,84,782 A * 11/1999 Inoue ..... 463/20
6,086,066 A * 7/2000 Takeuchi et al. ..... 273/143 R
6,227,971 B1 * 5/2001 Weiss ..... 463/20
6,471,588 B2 * 10/2002 Sakamoto ..... 463/20
6,726,204 B2 * 4/2004 Inoue ..... 273/143 R
2004/0012145 A1 * 1/2004 Inoue ..... 273/143 R

FOREIGN PATENT DOCUMENTS

GB 2106292 A * 4/1983 ..... G07F/17/34

* cited by examiner

*Primary Examiner*—Derris H. Banks
*Assistant Examiner*—Alex F. R. P. Rada, II
(74) *Attorney, Agent, or Firm*—Young & Thompson

(57) ABSTRACT

Behind a display window, plural of reel units are disposed. Each of the reel units has an outer reel and an inner reel that are coaxially and independently rotated. The inner reel carries plural inner symbols at a predetermined pitch. The outer reel carries outer symbols representing conditions of a second rotation of the inner reel. The plural inner reels stop rotating to complete a symbol combination. When the symbol combination for losing is completed, the outer reel is rotated and stopped. Then the second rotation of the inner reel starts rotating, which carries the inner symbol on which the outer symbol is disposed. In the second rotation, a rotational direction and a rotational speed is determined in accordance with a kind of the outer symbol. When the second rotation of the inner reel stops, another symbol combination is completed on the winning line.

18 Claims, 7 Drawing Sheets

SYMBOL DISPLAY DEVICE FOR GAME MACHINE

BACKGROUND OF THE INVENTION

1. Field of the Invention

The present invention relates to a symbol display device, for example, used for a pachinko machine or a slot machine, especially to a double reel type of a symbol display device that includes an outer reel and an inner reel.

2. Description Related to the Prior Art

In a slot machine and a pachinko machine, a symbol display device is used. As the symbol display device, there is a reel type in which plural reels are rotated to display in a display window symbols arranged on a periphery of each of the reels, and a video type in which the rotation of the reels is imitatively represented by displaying the moving symbols on a CRT based on a graphic data stored in a ROM. In these types of the symbol display devices, when the symbols become stationarily displayed, the win or the loss of the game is determined on basis of a kind of a symbol combination completed on the winning line.

As it is interesting for a player so much whether the symbol combination for the winning is completed, it is important to arrange the displaying of the symbol combination, in order to increase interests of the player. In the reel type, however, it is hard to increase the number of the symbols and kinds thereof for each single reel, which cannot have too great a size. In order to increase the number of the symbols, a symbol display device is known that has a reel pair constructed of a transparent outer reel and an inner reel rotating inside the outer reel. As both peripheries of the inner and outer reels are provided with the symbols, the number of the symbol combinations to be constructed is larger than when the reel is simply used.

However, even in such a symbol display device including the inner and outer reels, the variations of the display of the symbol combinations are not enough to interest the player on the games moreover.

SUMMARY OF THE INVENTION

An object of the present invention is to provide a symbol display device for displaying symbols so as to increase expectations for winning of a player.

In order to achieve the object and other objects, the symbol display device of the present invention has a reel unit constructed of a first reel carrying first symbols at a predetermined pitch plural for constructing a symbol combination for winning and a second reel carrying plural second symbols for illustrating situations of a second rotation of the first reels. A driving control means of the reel unit controls the rotation and the stop of the first reel to complete a temporary symbol combination on the winning line. After the completion of the temporary symbol combination, the second reel starts rotating and stops. When the second symbol on the second reel appear in the display window, the second rotation of the first reel is made in a situation illustrated in the second symbol. When the first reel stops, the last symbol combination is completed on the winning line.

According to the invention, in performing the game once, as the first reel is rotated twice, the enjoyment for the game of player becomes twice. Further, whenever the temporary symbol combination is for losing, the last symbol combination can be for winning.

Accordingly, the expectations of the player for the winning of the game become larger. Further, as the symbol combination varies in performing the game once, the visually appeal becomes larger.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
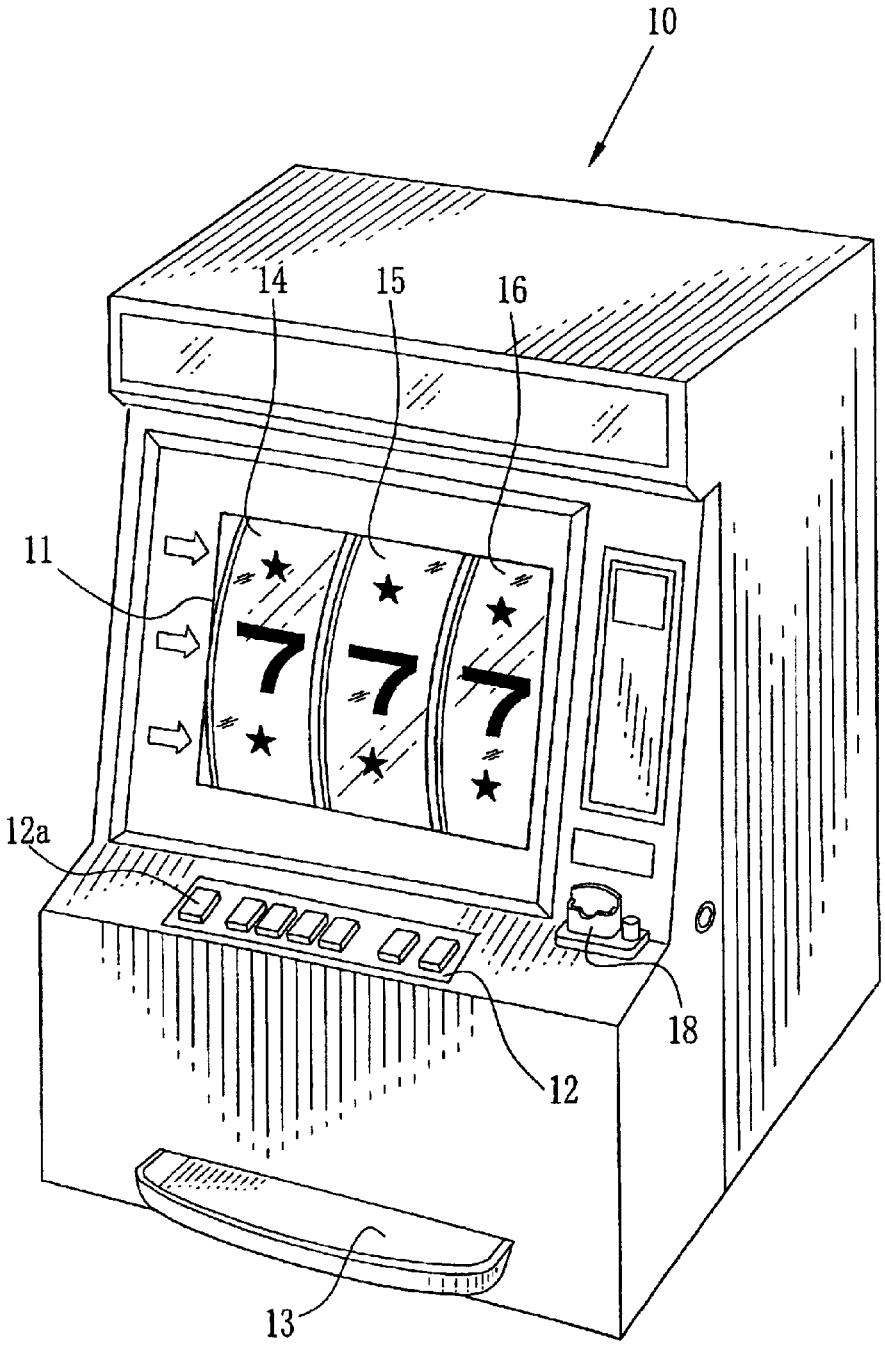
FIG. 1 is a perspective view of a slot machine in which a symbol display device of the present invention is loaded.

In FIG. 1, a slot machine 10 is provided with a display window 11, an operation panel 12 and a coin receiver 13. Behind the display window 11 three reel units are disposed. Each of the reel units is constructed of a reel pair and a pair of stepping motors for driving the reel pair. The reel pair is constructed of an inner reel 31 and an outer reel 32 (see FIG. 3) that are coaxially and independently rotated. On each of the first–third reel pairs 14–16, several sorts of symbols are arranged vertically, and while the first–third reel pairs 14–16 are stopped, three of the symbols on each of the first–third reel pairs 14–16, totally nine symbols are displayed. In the operation panel 12, as already known, a bet button, a pay-out button, a game start button (not shown) and the like are provided.

Figure 2:
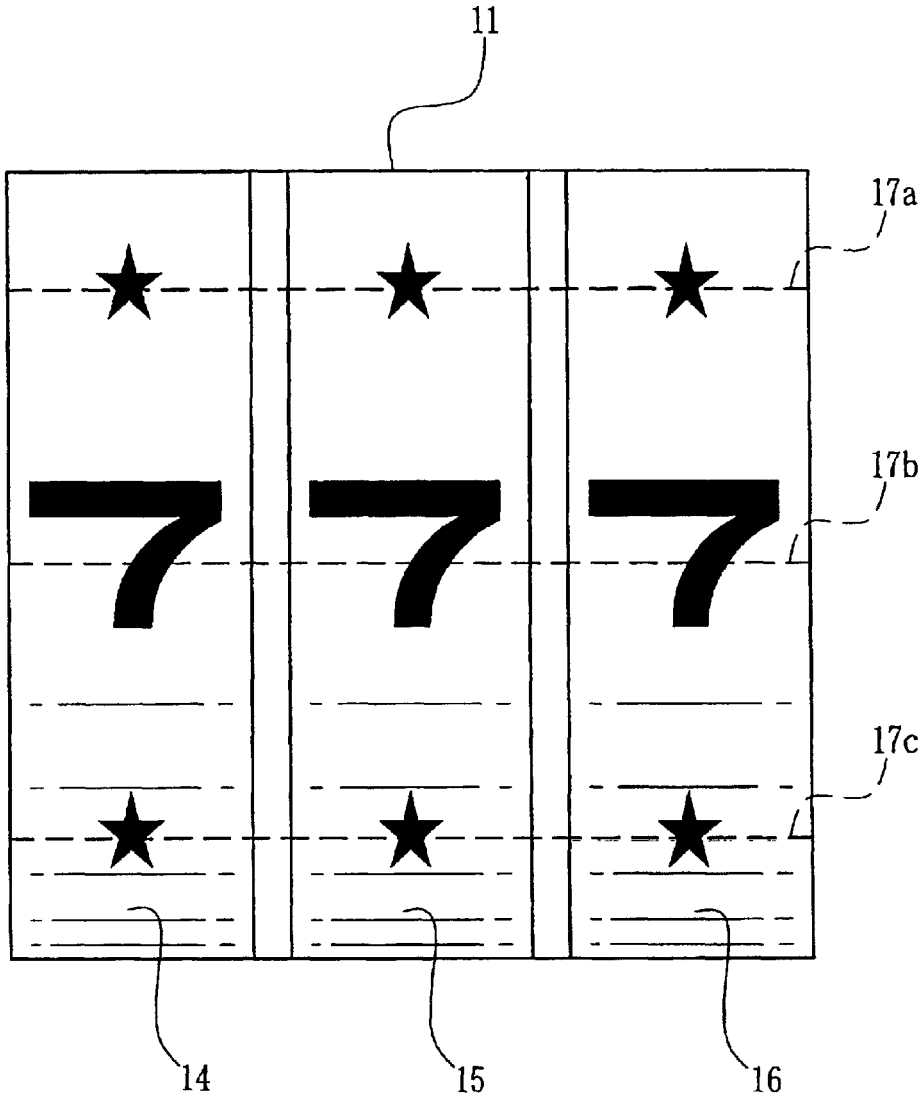
FIG. 2 is a plan view of a display window of the slot machine.

As shown in FIG. 2, there are winning lines 17*a*–17*c* through the display window. When the first–third reel pairs 14–16 stop, the symbol combinations completed on each of the winning lines 17*a*–17*c* are for winning or for losing. The number of the winning lines 17*a*–17*c* to be activated is increased each time that the bet button of the operation panel is depressed after inserting coins (including medals and tokens) into a coin slot 18. When the symbol combination is completed on the activated one of the winning line 17*a*–17*c*, the player wins a slot game.

Each of the first–third reel pairs 14–16 is rotated with stepping motors 48–50, 55–57 (see FIG. 5), and usually displays the symbols moving downward in FIG. 2. The inner reels 31 of the first–third reel pairs 14–16 start rotating when a start button 12*a* on the operation panel 12 is depressed. The outer reels 32 of the first–third reel pairs 14–16 are rotated when predetermined conditions are satisfied.

Figure 3:
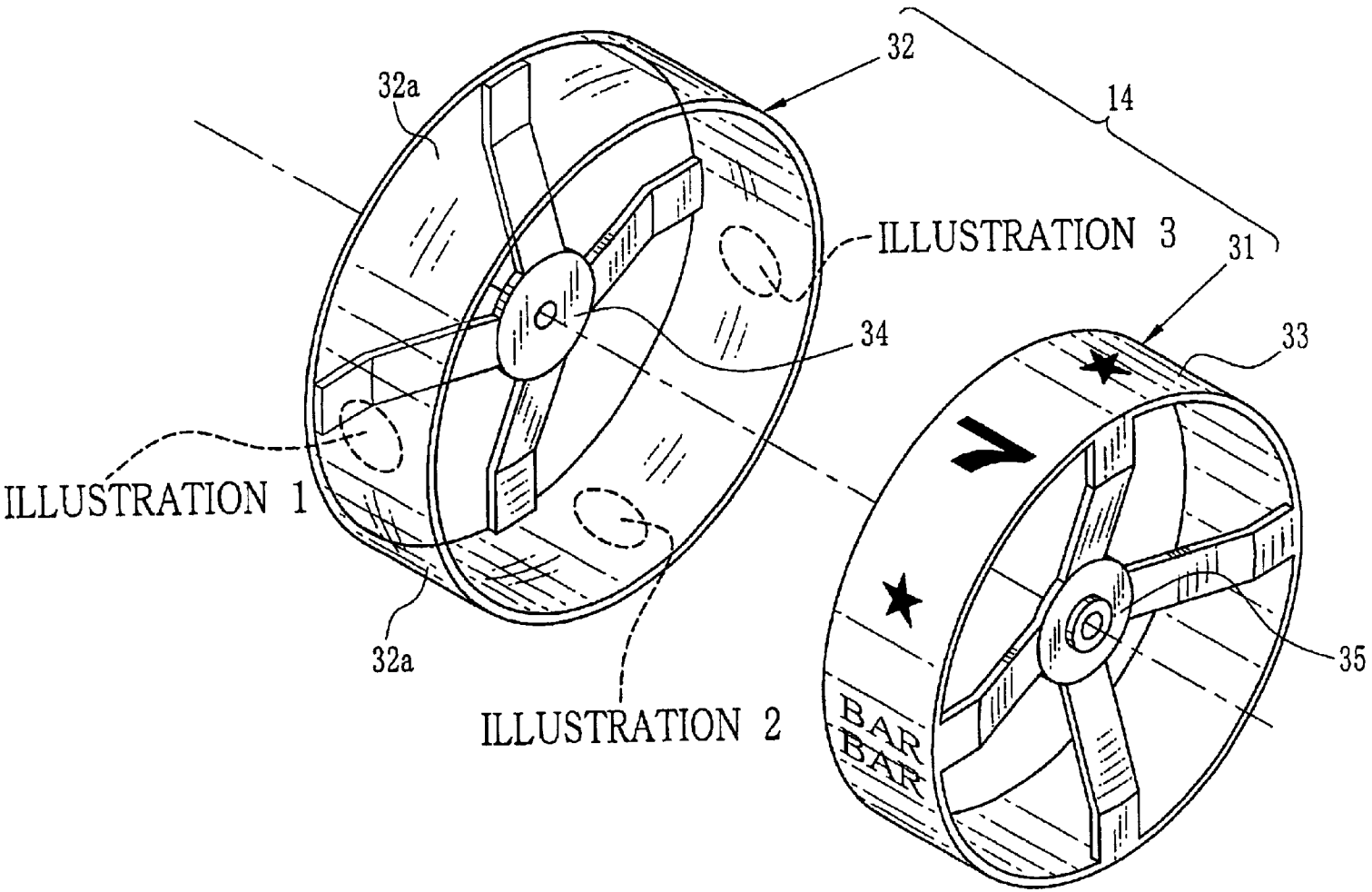
FIG. 3 is a perspective view of inner and outer reels.

In FIG. 3, the inner reel 31 is formed of an opaque resin, and a symbol sheet 33 is applied around with a periphery of the inner reel 31. An attachment plate 35 of the inner reel 31 is attached to the stepping motor 48. The outer reel 32 is formed of a transparent plastic resin, and a symbol sheet 32*a* is applied on a periphery of the outer reel 32 and wound about the outer reel 32. An attachment plate 34 of the outer reel 32 is attached to the stepping motor. Note that, as the first–third reel pairs 14–16 have a same structure, only the first reel pair is illustrated, and explanations of the second and third reel pairs 15, 16 are omitted.

Figure 4A:
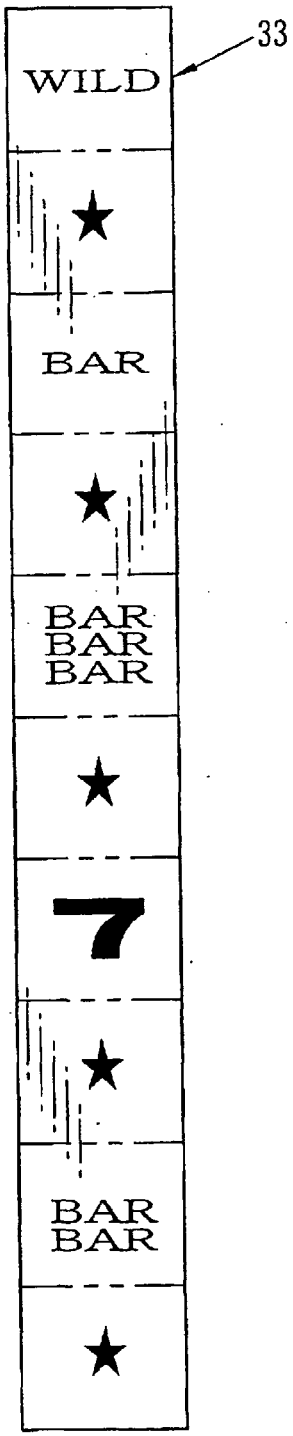
FIG. 4A is an exploded view of a symbol sheet for the inner reel.

In FIG. 4A, for example, ten inner symbols are arranged at a predetermined pitch on the inner symbol sheet 33. Five of the inner symbols are "7", "WILD", "BAR", "BAR BAR" and "BAR BAR BAR". Between these inner symbols, "STAR" symbols are disposed. The "STAR" symbols are losing symbols, and do not construct any symbol combinations for winning. Namely, the symbol combination including the symbol "STAR" is always that for losing. Further, kinds, number and arrangement of the inner symbols on each of the inner reels 31 may be varied.

Figure 4B:
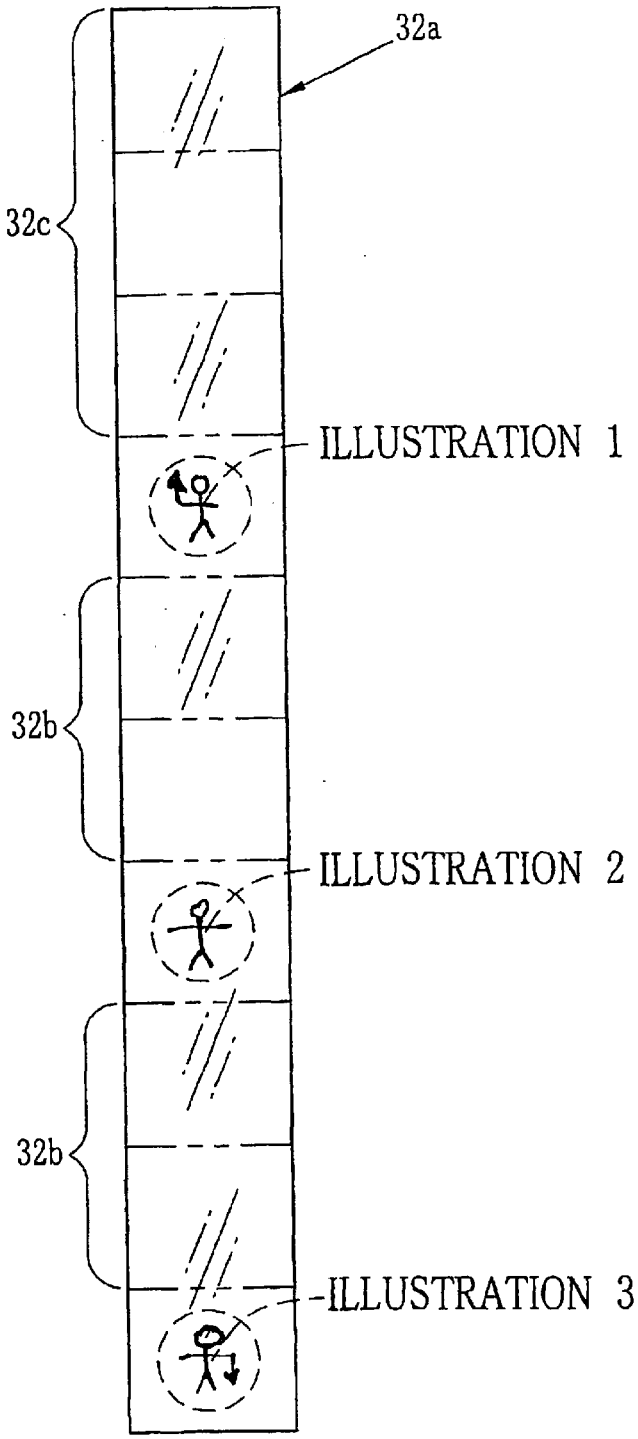
FIG. 4B is an exploded view of a symbol sheet for the outer reel.

In FIG. 4B, an outer symbol sheet 32*a* carries "Illustrations 1–3" as three kinds of outer symbols, which are pictures of "swooping eagle", "napping lion", and "climbing koala bear" respectively. "Illustrations 1–3" are second rotation symbols, each of which represents a second rotation of the inner reel 31. These pictures of the outer symbols are originally printed in regions illustrated with dotted lines, although being illustrated near to the areas with leading lines for convenience in FIG. 4B. Between the second rotational symbols, there are blanks 32*b* corresponding to two of the inner symbols, and a blank 32*c* corresponding to three of the inner symbols. When the blank 32*c* entirely appears upon the stop of all outer reels 32, only the inner symbols are displayed. Especially while the slot game is not performed, none of the outer symbols is displayed.

In the present invention, when one of the outer symbols is stationarily displayed on a predetermined one of the inner symbols after rotation of the outer reel, the inner reel starts rotating at determined second rotational conditions (direction and speed). The outer symbols "Illustrations 1–3" allude to the determined second rotational conditions, and the inner symbol for the second rotation of the inner reel 31 is the symbol "7". Namely, when the outer symbol "Illustration 1" is displayed on the inner symbol "7" on the winning line, the inner reel 31 rotates faster in the rotational direction, to which "swooping eagle" of "Illustration 1" alludes. When "Illustration 3" is displayed on "7", the inner reel 31 makes a secondary rotation more slowly and reversely, to which "climbing koala bear" of "Illustration 3" alludes. When "Illustration 2" is displayed on "7", the inner reel 31 does not rotate, to which "napping lion" of "Illustration 2" alludes.

When the second rotation of the inner reel 31 stops, an inner symbol combination appears on the winning line to determine the win or the loss based on the symbol combination. Note that, as the inner symbol is more indistinctly perceived under the outer symbol, it is preferable to form transparent parts in the outer symbol more or to print the outer symbol at such a low density that the inner symbol can be seen through it. Also, the outer symbol may have a form of a drawing including only lines.

Figure 5:
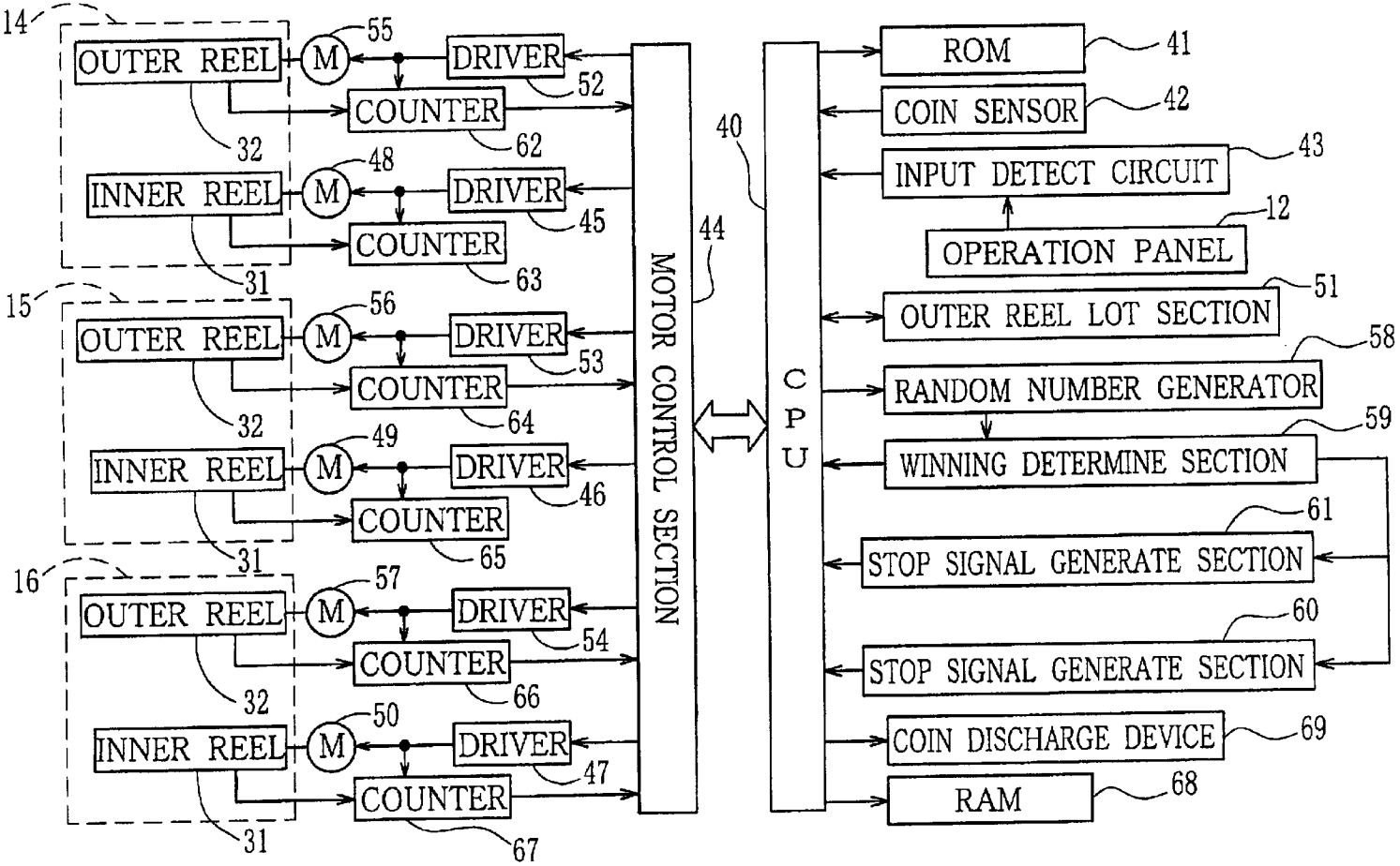
FIG. 5 is an electrical block diagram of the slot machine.

In FIG. 5, a coin sensor 42 is provided behind the coin slot 18, and generates at detecting an inserted coin a coin detect signal to send it to CPU 40. When the bet button in the operation panel 12 is operated after insertion of the coin in the coin slot 18, an input detect circuit 43 generates an operation signal to input it in the CPU 40. The CPU 40, when receiving the operation signal, activates the winning lines in accordance with the number of the inserted coins. When the start button 12*a* in the operation panel 12 is depressed, the input detect circuit 43 generates a start signal to input it to the CPU 40.

The CPU 40, corresponding to the receipt of the start signal, actuates an outer reel lot section 51, which is constructed of a random number generator, a random number sampling circuit and a rotate determination table. In the outer reel lot section 51, a random number are sampled and checked by referring to the rotate determination table to determine whether the outer reel 32 will be rotated. After the determination thereof, the outer reel determining section 51 sends an outer reel rotate determination signal to the CPU 40.

Further, the CPU 40, in response to the start signal, actuates a random number generation circuit 58. In the random number generation circuit 58, a random number is sampled and input in a winning determine section 59. In the winning determine section 59 the win or the loss of the slot game is determined from this random number. Then the symbol combination for winning or losing to be completed is determined. When completion of the symbol combination for winning is determined, an activated one of the winning lines 17*a*–17*c* for completing the symbol combination for winning thereon is determined. Further, when rotation of the outer reel 32 is determined, a temporary symbol combination constructed of inner symbols before rotation of the outer reel 32, and the outer symbols to be displayed after rotation of the outer reel 32 are determined. The temporary symbol combination is always the symbol combination for losing. Accordingly, when the losing of the game is determined, both the temporary symbol combination constructed of the inner symbols and the last symbol combination after the secondary rotation of the inner reels are for losing. Otherwise, when the winning of the game is determined, the temporary symbol combination is for losing and the last symbol combination is for winning. The winning determine section 59 sends the CPU 40 a symbol display signal according to the last symbol combination, the temporary symbol combination and the outer symbols.

After input of the symbol display signal and the outer reel rotate determination signal, the CPU 40 drives a motor regulate section 44. The motor regulate section 44 sends a drive pulse through drivers 45–47 to the stepping motors 48–50 attached to the inner reels 31 of the first–third reel pairs 14–16, such that the inner reels 31 are rotated.

After a time is passed, the CPU 40 actuates a stop signal generate section 60. The stop signal generate section 60 sends an inner reel stop signal to the motor regulate section 44 to stop the inner reels 31. Further, in order to rotate the outer reels 32, the CPU 40 drives through drivers 52–54 the stepping motors 55–57 attached to the outer reel 32 of the first–third reel pairs 14–16. Thereafter, the CPU 40 drives a stop signal generate section 61. The stop signal generate section 61 sends the outer reel stop signal to the motor regulate section 44 to stop the outer reel 32.

The stop signal generate sections 60, 61 input the CPU 40 a stop position data representing the rotation stop position of the stepping motors 48–50, 55–57 such that the temporary symbol combination, the outer symbols and the last symbol combination are displayed at predetermined positions.

The stepping motors 48–50, 55–57 rotate at a unit step angle when the drive pulse is input through the drivers 45–47, 52–54. Each of the inner reel 31 and the outer reel 32 is provided with a fragment (not shown), and when the inner reel 31 or the outer reel 32 is rotated, the fragment is detected with a photo interrupter (not shown). The photo interrupter, when detecting the fragment, generates a reset signal to send it to counters 62–67. The counters 62–67 count the number of the drive pulses of the stepping motors

48–50 and 55–57 as a count number, and reset the count number to "0" when receiving the reset signal. Therefore, the count number of the counters 62–67 represents a rotational position of each of the inner and outer reels 31, 32. The rotational position corresponds to positions of the symbols on the inner reel 31 and the outer symbols on the outer reel 32. Accordingly, the symbols in the display window 11 are discriminated, based on the count number of the drive pulse sent to the stepping motors 48–50, 55–57.

When the symbol combination for winning is completed, a number of the dividends coins is stored in a RAM 68, with reference of a data of the number of the dividends coins that is stored in a ROM 41. When the pay out button in the operation panel 12 is operated, a coin discharge device 69 is driven such that the dividends coins of the number stored in the RAM 68 may be discharged. Note that the RAM 68 is used for temporary storing several data, such as for a number of the betted coin and a number of the inserted coins, which are generated in processing of the slot game.

Figure 6:
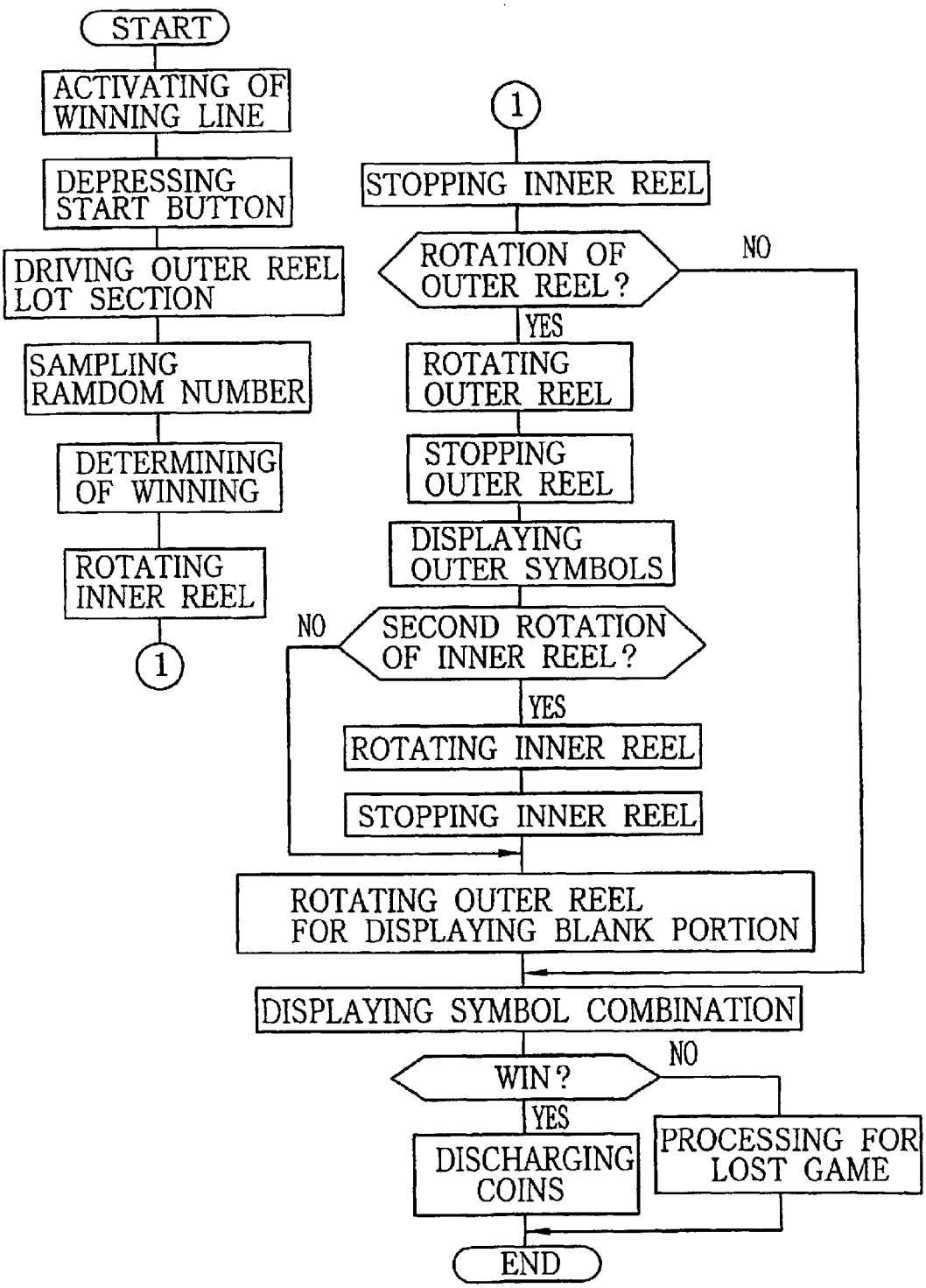
FIG. 6 is a flow chart of a slot game.

Effects of operation of the symbol display device in the embodiment will be described now. As shown in FIG. 6, after inserting the coins through the coin slot 18, the player depresses the bet button in the operation panel 12 to activate part or all of the winning lines 11*a*–11*c*.

When the player depresses the start button 12*a* in the operation panel 12, the start signal is input in the CPU 40. The CPU 40 drives the outer reel lot section 51 so as to determine whether to rotate the outer reel 32. Then the CPU 40 drives the random number generation circuit 58 to carry out the sampling of the random number. Based on the random number, in the winning determine section 59 the winning or the losing is determined, and further, the symbol combination, the temporary symbol combination and the outer symbols are determined.

The CPU 40 drives the stepping motors 48–50 through the motor regulate section 44 at a same time, to start rotating the inner reels of the first–third reel pairs 14–16 respectively. When no rotation of the outer reels 32 is determined, the CPU 40 stops the inner reels 31 through the motor regulate section 44 so as to complete a symbol combination determined by the winning determine section 59. When the symbol combination for losing is completed, the process of the game becomes end, and when the symbol combination for winning is completed on the winning line, the player wins the game.

When rotation of the outer reel is determined, the CPU 40 stops the rotation of the inner reels 31 through the motor regulate section 44 so as to complete the temporary symbol combination for losing. In this case, for example, the inner symbol "7" of the first reel pair appears on the activated winning line. Then, the CPU 40 actuates the motor control section 44 to rotate the outer reels 32. Thereafter, the CPU 40 stops the outer reels 32 through the motor control section 44 to display the outer symbols determined in the winning determine section 59. Thereby the outer symbol on the outer reel 32 in the first reel pair 14 is disposed on the inner symbol "7". The CPU 40 makes the inner reel 31 start the second rotation through the motor regulate section 44 in accordance with the outer symbol, and stops the inner reel 31 such that the inner symbols are arranged on the winning line to complete the last symbol combination. Thereafter, the CPU 40 rotates the outer reels 32 such that all of the symbols on the displayed symbols on the inner reels 31 in the display window may be covered with the blanks 32*c*, each of which is three times as long as the predetermined pitch of the symbols. Thus the displayed symbols and the symbol combinations are more clearly perceived. When the second rotation of the inner reel 31 is made, the winning or the losing of the game is discriminated, in accordance with the symbol combination completed on the activated winning line.

When the symbol combination for winning is completed, the CPU 40 makes the RAM 68 store the number of the dividends coins corresponding to the rank of the symbol combination for winning.

Note that the dividends coins may be discharged at stopping the second rotation of the inner reels 31 when the inner symbols are clearly perceived even through the outer symbols. In this case, the outer reel 32 may be rotated such that the blank 32*c* covers all the symbols of the inner reel 31 before starting the next slot game. Further, the slot machine may have a credit counter for storing the number of the dividend coins before discharging thereof by depressing the discharge button. In this case, when the bet button is depressed, the winning line is activated, and the number of the dividend coins stored by the credit counter becomes smaller, according to the number of the activated winning lines.

Figure 7:
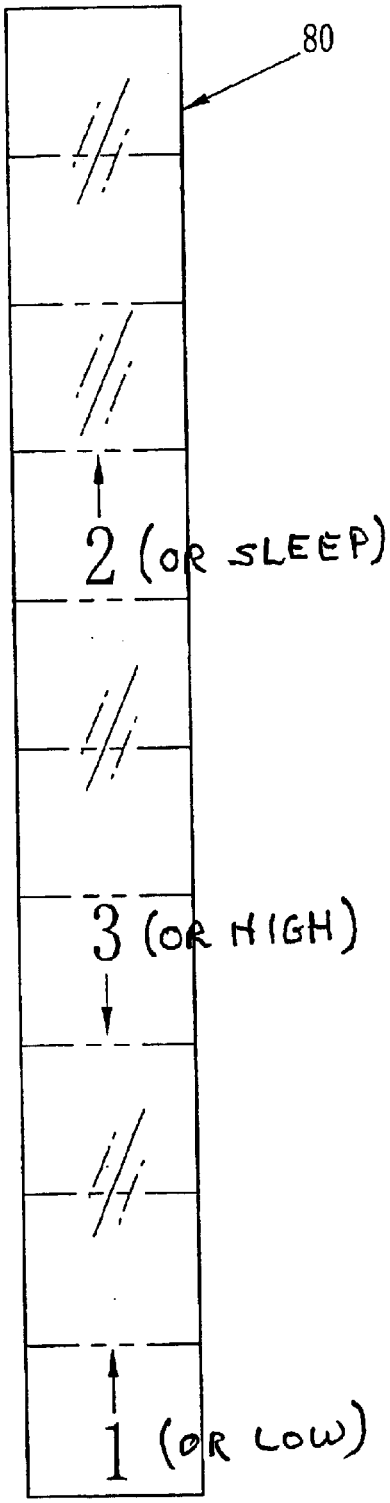
FIG. 7 is an exploded view of the symbol sheet for the outer reel in another embodiment.

In the embodiment above, instead of pictures of "swooping eagle", "napping lion" and "climbing koala bear", "Illustrations 1–3" of the second rotation symbols may be combination symbols, for example, as shown in FIG. 7, "↓HIGH", "SLEEP" and "↑LOW" respectively, each of which includes an arrow indicia illustrating the rotational direction and a word representing the degree of the rotational speed. Further, the outer symbol may directly represent the amount of the rotation of the inner reel 31.

Alternatively, as shown in FIG. 7, the three types of the second rotation symbols "↑2", "↓3" and "↑1" on an outer symbol sheet 80. When the second rotation symbol "↑2" is displayed, the inner reel 31 rotates for the two pitches in the reverse direction. When the second rotation symbol "↓3" is displayed, the inner reel 31 rotates for the three pitches in the normal direction. When the second rotation symbol "↑1" is displayed, the inner reel 31 rotates for the one pitch in the reverse direction. In the case, the player can momentarily know the second rotate condition of the inner reel.

Figure 8:
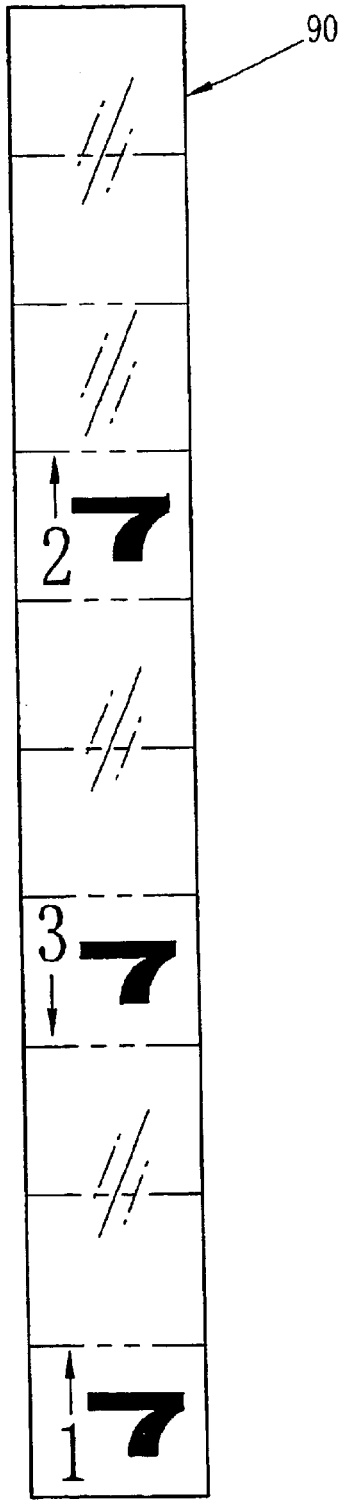
FIG. 8 is an exploded view of the symbol sheet for the outer reel in the still another embodiment.

Further, as the outer symbol, a paired symbol may be formed from the hit symbol and the second rotation symbol, which illustrates the amount of second rotation of the inner reel 31. As shown in FIG. 8, there are three of the outer symbols, such as "↑2, 7", "↓3, 7" and "↑1, 7" on an outer symbol sheet 90. When the paired symbol "↑2, 7" is displayed, the inner reel 31 is rotated for the two pitches in the reverse direction. When the paired symbol "↓3, 7" is displayed, the inner reel 31 is rotated for the three pitches in the normal direction. When the paired symbol "↑1, 7" is displayed, the inner reel 31 is rotated for the one pitch in the reverse direction. Further, "7" of the outer symbols can construct the symbol combination for winning with the other outer symbols or the inner symbol.

In the present invention, kinds, numbers and arrangements of symbols on the inner and outer reels are not restricted in the above embodiment. For example, the hit symbols and the losing symbols may be provided on the outer reel 32, and the second rotation symbols may be provided on the inner reel 31. Further, normal symbols, for example the hit symbols, may be disposed between the second rotation symbols.

In the embodiment above, a length of the periphery of the inner or outer reels may be varied such that the number of the inner symbols and the outer symbols may become larger, through which the slot game becomes more variable.

Note that in the symbol display device of the present invention, conditions for the rotation of the outer reel 32 and the second rotation of the inner reel 31, which are, for example, timing of stop and start of the rotation, order to stop the rotation, the content of the game, and the like, may be set adequately. According to the slot machine, a term "Riichi situation" is widely used. The Riichi situation is a situation nearest to the winning. For example, the two inner reels are stopped, and the inner symbols "7" of each of the stopped inner reels is disposed on a winning line, and the remaining reel is rotating. When the symbol combination for losing is completed by stopping the rotation of the remaining inner reel 31 in the Riichi situation, only the outer reel 32 on the remaining inner reel may be rotated. Furthermore, the outer reel 32 may be rotated at each time of playing a game, and also, may be rotated only when a win is determined for a result of the game. Note that, when the outer reel 32 is rotated so often, the player is likely to lose the expectations for the rotation of the outer reel. Accordingly, the outer reel 32 is rotated frequently enough for the player to have expectations therefor.

Further, after stopping the second rotation of at least one inner reel, the outer reels are rotated to set the blank portion of three symbols into the display window. Instead thereof, the outer reel may be rotated to set the blank portion to the display window during or just before starting the second rotation of the inner reel.

The second rotational condition of the inner reel 31 may be set optionally, for example, the higher speed in the reverse direction and the like. For this second rotational condition, the second rotation symbol alluding to this second rotational condition may be provided as any suitable visibly distinct images in symbolic, pictorial or patterned forms. As the second rotation symbol illustrating the faster rotation of the inner reel in the reverse direction there are illustrations and pictures, for example, that of "Antelope climbing rock". In the blank portions of the outer reel, the losing symbols may be arranged in a shape similar to those among the inner symbols.

In the embodiment of the present invention, all of the outer reels are rotated. However, only one or two outer reels may be rotated. In this case, the reel pairs in which the inner reels are to be rotated may be determined in each game.

In the present invention, the symbol display device is three reel type in which the three reel pairs are disposed in parallel. However it may be a four reel type or a five reel type. Further, all of the reel units have two reels. Instead thereof the reel unit having only one reel may be used. For example, the first reel unit has a reel pair, and each of the second and third reel units has the single reel. Furthermore, the number of the display window is one. However, the display window may be provided for each of the reel units.

In the above embodiment, after determining the winning with reference of the sampled random numbers, each of the reels are controlled so as to complete the determined symbol combination. However, the symbols to be displayed may be determined with reference of the sampled random number, and thereafter, each reels may be controlled such that the determined symbols may be displayed. Thereby the symbol combination is completed, and the judgment of the winning is carried out in accordance with the completed symbol combination.

Further, the symbol display device 38 may be loaded in the pachinko machine, namely pinball machine of an upright type, or other game machines.

Note that the present invention is also applied to a symbol display device of a video type that, based on a graphic data, imitatively displays the moving of the symbols in accordance with the rotation of the reels.

Various changes and modifications are possible in the present invention and may be understood to be within the present invention.

What is claimed is:

1. A symbol display device for a game machine, in which a win or a loss of a game is determined in accordance with a kind of a symbol combination completed on a winning line extending across a display window, said symbol display device comprising:

plural reel units disposed across said winning line, at least one of said reel units having a double reel structure constructed of a first reel and a second reel which are coaxially and independently rotated;

plural first symbols formed at a predetermined pitch on a periphery of said first reel;

plural second symbols formed on a periphery of said second reel, each of said second symbols indicating at least one of a speed, direction and amount of a second rotation of said first reel; and a reel unit driving control unit for rotating and stopping said first reel and said second reel, and for re-rotating and stopping said first reel in accordance with the indication of one of said second symbols stopped in said display window.

2. A symbol display device described in claim 1, wherein said reel unit driving control unit starts rotating said second reel from the start to the stop of rotation of said first reel.

3. A symbol display device described in claim 1, wherein after the stop of the rotation of said first reel, said reel unit driving control unit carries out the rotation and the stop of said second reel for determining the second rotation of said first reel.

4. A symbol display device described in claim 3, wherein said first reel is an inner reel, and said second reel is an outer reel inside which said inner reel is disposed.

5. A symbol display device described in claim 4, wherein said periphery of said outer reel is transparent, and said first symbols are observable through said periphery of said outer reel.

6. A symbol display device described in claim 5, wherein said second symbols are arranged at pitch that is an integer times as great as said predetermined pitch, and said integer is 2 or more.

7. A symbol display device described in claim 6, wherein said symbol combination is completed by said first symbols on said plural reel units.

8. A symbol display device described in claim 7, wherein each of said second symbols comprises an arrow indicia representing a rotational direction and letters representing a degree of rotational speed about the second rotation of said inner reel.

9. A symbol display device described in claim 7, wherein each of said second symbols is an illustration or a picture representing a rotational direction and a degree of rotational speed about the second rotation of said inner reel.

10. A symbol display device described in claim 7, wherein each of said second symbols comprises an arrow indicia representing a rotational direction and a number representing an amount of the rotation about the second rotation of said inner reel.

11. A symbol display device described in claim 7, wherein at least one of said second symbols is a combination of an indicia representing said situation of said second rotation and a hit symbol for completing the win of the game, and said hit symbol constructs said symbol combination instead of said first symbols on said inner reel.

12. A symbol display device described in claim 7, wherein said outer reel further includes a hit symbol for completion of said win of said game between neighboring two of said second symbols, to construct said symbol combination instead of said first symbols on said inner reel.

13. A symbol display device for a game machine, the device comprising:

plural reel units arranged side-by-side;

at least one of said reel units having a first reel and a second reel that are coaxial and independently rotated, said first reel having plural first symbols thereon and said second reel having plural second symbols thereon, said second symbols determining at least one of a direction, speed and amount of respin of said first reel;

a reel unit driver that spins said first and second reels; and a processor that, when said first and second reels have been spun and stopped, determines whether one of said second symbols is displayed and causes said reel unit driver to respin said first reel in the one of the direction, speed and amount determined by the displayed one of said second symbols.

14. The device of claim 13, further comprising a random number generator that generates a number that determines whether said second reel is to be spun by said reel unit driver.

15. The device of claim 13, wherein said second reel includes a section that is transparent, at least as large as one of said first symbols and does not include one of said second symbols, whereby at least one of said first symbols is visible through said section.

16. The device of claim 13, wherein at least one of said second symbols indicates a respin of said first reel in a first direction and another of said second symbols indicates a respin of said first reel in a second direction opposite the first direction.

17. The device of claim 13, wherein at least one of said second symbols indicates a respin of said first reel at a first speed and another of said second symbols indicates a respin of said first reel at a second speed different from the first speed.

18. The device of claim 13, wherein at least one of said second symbols indicates a respin of said first reel in a first amount and another of said second symbols indicates a respin of said first reel in a second amount different from the first amount.

* * * * *